US006536204B2

(12) United States Patent
Lenz et al.

(10) Patent No.: US 6,536,204 B2
(45) Date of Patent: Mar. 25, 2003

(54) BURNER CONFIGURATION FOR GAS TURBINE

(75) Inventors: Manfred Lenz, Wolfsburg (DE); Martin Lenze, Essen (DE); Carsten Tiemann, Bielefeld (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/795,091

(22) Filed: Feb. 28, 2001

(65) Prior Publication Data

US 2001/0025491 A1 Oct. 4, 2001

Related U.S. Application Data

(63) Continuation of application No. PCT/DE99/02541, filed on Aug. 13, 1999.

(30) Foreign Application Priority Data

Aug. 31, 1998 (DE) ..... 198 39 639

(51) Int. Cl.[7] ..... F23R 3/16
(52) U.S. Cl. ..... 60/39.37
(58) Field of Search ..... 60/39.37, 725, 60/737, 738, 746, 747

(56) References Cited

U.S. PATENT DOCUMENTS

| | | | | |
|---|---|---|---|---|
| 2,708,926 A | | 5/1955 | Huber et al. | |
| 3,118,489 A | | 1/1964 | Anthes | |
| 4,373,342 A | | 2/1983 | Willis et al. | |
| 4,698,963 A | * | 10/1987 | Taylor | 60/737 |
| 5,150,570 A | * | 9/1992 | Shekleton | 60/738 |
| 5,216,885 A | * | 6/1993 | Taniguchi et al. | 60/737 |
| 5,235,814 A | * | 8/1993 | Leonard | 60/738 |

OTHER PUBLICATIONS

Rolls Royce Ltd. The Jet Engine, 1973, p. 167.*
Japanese Patent Abstract No. 08303779 (Osamu), dated Nov. 22, 1996.

* cited by examiner

*Primary Examiner*—Louis J. Casaregola
(74) *Attorney, Agent, or Firm*—Laurence A. Greenberg; Werner H. Stemer; Ralph E. Locher

(57) ABSTRACT

A burner configuration includes a combustion chamber. A multiplicity of burners are disposed in the combustion chamber. Each of the burners has an outlet opening into the combustion chamber. Flow-guidance elements each at least partly form a respective one of the outlets of at least some of the burners. The flow-guidance elements project into the combustion chamber for guiding a fuel-gas flow discharging from the burners into the combustion chamber. As a result, combustion oscillations are suppressed.

9 Claims, 3 Drawing Sheets

BURNER CONFIGURATION FOR GAS TURBINE

CROSS-REFERENCE TO RELATED APPLICATION

This application is a continuation of copending International Application No. PCT/DE99/02541, filed Aug. 13, 1999, which designated the United States.

BACKGROUND OF THE INVENTION

1. Field of the Invention

The invention relates to a burner configuration including a burner which opens into a combustion chamber. The burner configuration is, in particular, a burner configuration for a gas turbine.

A method for suppressing thermoacoustic oscillations in the combustion chamber of a gas turbine is described in German Published, Non-Prosecuted Patent Application DE 43 39 094 A1. During the combustion of fuels in the combustion chamber of a stationary gas turbine, an aircraft engine or the like, instabilities or pressure fluctuations may occur due to combustion processes, and those instabilities or pressure fluctuations, under unfavorable conditions, excite thermoacoustic oscillations, which are also referred to as combustion oscillations. The latter not only constitute an undesirable acoustic source, but they may also lead to inadmissibly high mechanical loads on the combustion chamber. Such a thermoacoustic oscillation is actively damped by controlling a location of a heat-release fluctuation associated with the combustion by injecting a fluid.

European Patent Application EP A 0 931 979 A1 discloses a configuration for suppressing flame/pressure oscillations in a firing system, in particular a gas turbine. In that configuration, a flame is enclosed by a gas-envelope flow having a higher flow velocity. That prevents an annular vortex formation. In order to be able to obtain smaller gas volumes for the gas-envelope flow, a screen is provided which surrounds the gas-discharge openings of the burner and runs at a distance around the burner. Therefore, a flue-gas recirculation region connected to the combustion space is separated from the discharge location of the gas-envelope flow and thus from the gas-envelope flow. It is also proposed to use such configurations at each burner in an annular combustion chamber of a gas turbine.

U.S. Pat. No. 4,373,342 discloses a burner chamber of a gas-turbine engine. An inlet region of the gas-turbine combustion chamber is provided with a screen which projects into the combustion chamber. The screen reduces a carbon deposition in a head region of the combustion chamber and likewise reduces smoke emission.

2. Summary of the Invention

It is accordingly an object of the invention to provide a burner configuration, which overcomes the hereinafore-mentioned disadvantages of the heretofore-known devices of this general type and which has a favorable behavior in particular with regard to the avoidance of thermoacoustic oscillations.

With the foregoing and other objects in view there is provided, in accordance with the invention, a burner configuration, comprising a common combustion chamber and a multiplicity of burners disposed in the combustion chamber. Each of the burners has an outlet opening into the combustion chamber. Flow-guidance elements each at least partly form a respective one of the outlets of at least some of the burners. The flow-guidance elements project into the combustion chamber for guiding a fuel-gas flow discharging from the burners into the combustion chamber.

The fuel-gas flow may be a mixture of combustion air and, for example, oil or natural gas. The flow-guidance element serves to direct the fuel-gas flow discharging from the outlet. As a result, the zone of the combustion of the fuel-gas flow is displaced further into the combustion chamber. In addition, the flame shape of the combustion is influenced. The burner configuration, i.e. a system of the burner and the combustion chamber, is acoustically detuned by the effect on the shape and location of the combustion at some of the burners. This acoustic detuning prevents combustion oscillations or at least attenuates them. If a multiplicity of burners are present in a common combustion chamber, combustion oscillations cannot be predicted and are thus especially difficult to control. The complex system being formed of the multiplicity of burners in the common combustion chamber can be acoustically detuned simply and efficiently through the use of a flow-guidance element at a burner or even at a plurality of burners, in such a way that combustion oscillations occur at most with a small amplitude. In addition, a separation edge for vortices from the fuel-gas flow is provided by the flow-guidance element projecting into the combustion chamber. These vortices result in a backflow zone for at least some of the fuel-gas flow. This has a favorable effect on stabilization of the flame and on a reduction in the nitrogen-oxide emissions. The reduction in the nitrogen-oxide emission results from the flame temperatures being made more uniform by the mixing vortices.

In accordance with another feature of the invention, the flow-guidance element is a hollow cylinder or hollow truncated cone directed along a flow-guidance-element axis. The hollow cylinder or the hollow truncated cone also preferably ends at an imaginary top surface, in which case the top surface is not oriented perpendicularly to the flow-guidance-element axis. In other words: the hollow cylinder or the hollow truncated cone ends at a sloping top surface. The fuel-gas flow is therefore directed over a longer distance at a long side of the hollow cylinder or hollow truncated cone than at a short side opposite the long side.

In accordance with a further feature of the invention, the flow-guidance element is disposed around approximately half the outlet. A contact surface is therefore offered to the fuel-gas flow on one side. In addition to the effect on the shape of the combustion, the fuel-gas flow is thereby deflected by a short distance toward the open area. This in turn results in a displacement of the location of the combustion. Acoustic detuning and thus suppression of a combustion oscillation are thereby achieved in an especially effective manner.

In accordance with an added feature of the invention, the flow-guidance element is a sheet made of a high-temperature-resistant metal, in particular a steel.

In accordance with an additional feature of the invention, the combustion chamber is an annular combustion chamber of a gas turbine. In a gas turbine, in particular in a stationary gas turbine, a very high power release occurs during combustion. Combustion oscillations may not only have an acoustically disturbing effect in that case, they may even have a damaging effect. Suppression of combustion oscillations is therefore especially important in that case.

In accordance with a concomitant feature of the invention, the outlet has an outlet diameter and the flow-guidance element has a longest extent along the element axis. The longest extent has a length which is between one-sixth and one-half of the outlet diameter. The length of the longest extent preferably is between one and ten centimeters.

Other features which are considered as characteristic for the invention are set forth in the appended claims.

Although the invention is illustrated and described herein as embodied in a burner configuration, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
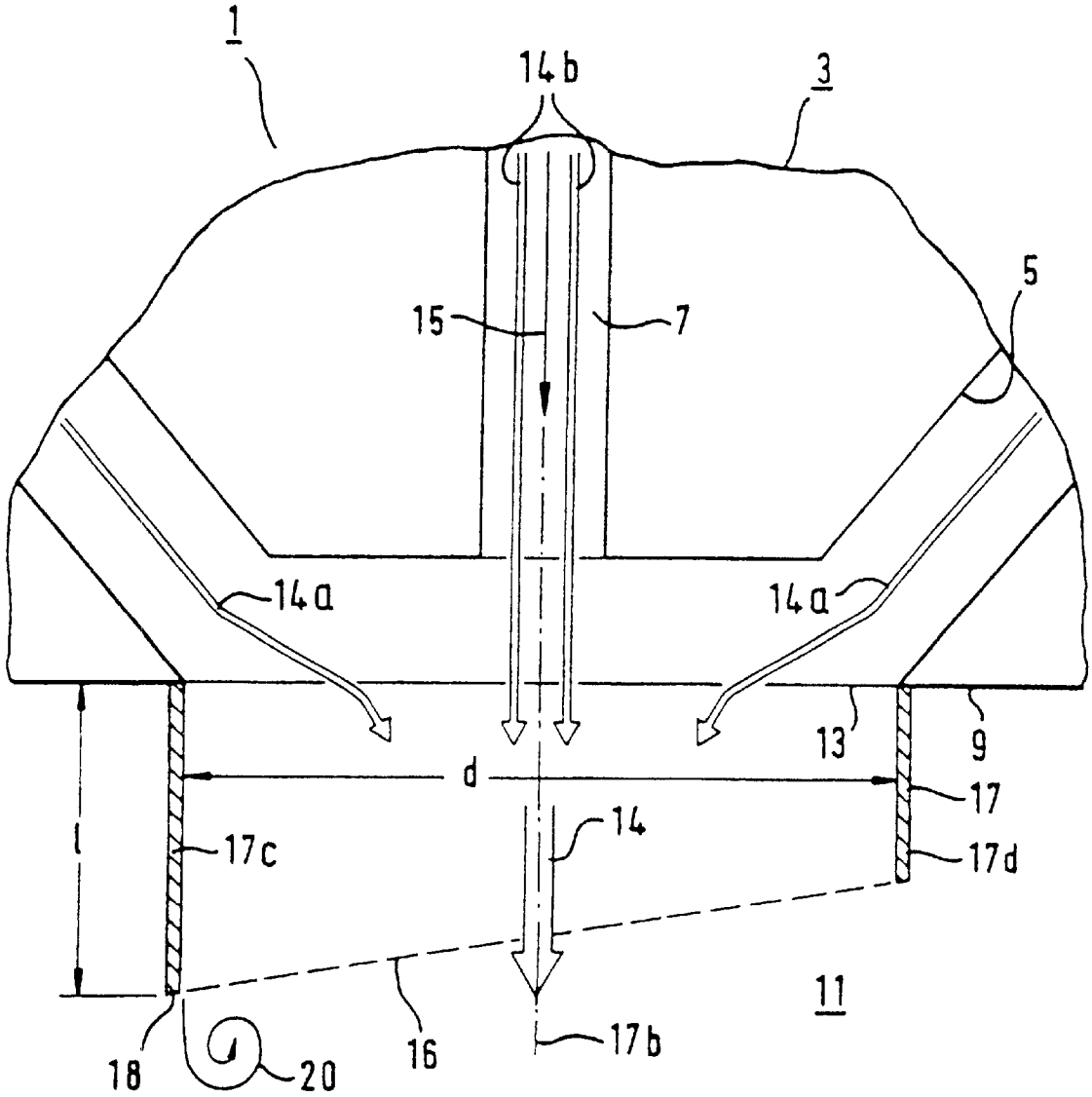
FIG. 1 is a fragmentary, diagrammatic, longitudinal-sectional view of a burner configuration.

Referring now in detail to the figures of the drawings, in which the same reference numerals have the same meaning, and first, particularly, to FIG. 1 thereof, there is seen a longitudinal section through a portion of a burner configuration 1. A burner 3 is disposed on a combustion-chamber wall 9 of a combustion chamber indicated by reference numeral 11. The burner 3 is a hybrid burner, i.e. it may be operated as a diffusion burner or as a premix burner. The burner 3 has an annular passage 5 as a premix stage. The annular passage 5 concentrically surrounds a pilot burner 7. A fuel/air mixture 14*a* is directed in the annular passage 5. This fuel/air mixture 14*a* combines with a fuel/air mixture 14*b* from the pilot burner 7 to form a fuel-gas flow 14. The fuel-gas flow 14 discharges from the burner 3 through an outlet 13 in an outlet direction 15. The outlet 13 is surrounded by a hollow-cylindrical flow-guidance element 17. The flow-guidance element 17 ends at an imaginary top surface 16. The flow-guidance element 17 is directed along a flow-guidance element axis 17*b*. In this case, the top surface 16 is not oriented perpendicularly to the flow-guidance-element axis 17*b*. The flow-guidance element 17 therefore ends at a sloping top surface 16. As a result, the flow-guidance element 17 has a long side 17*c* and a short side 17*d*. The fuel-gas flow 14 is directed over a slightly larger distance on the long side 17*c* than on the short side 17*d*. As a result, the fuel-gas flow 14 opens in the direction of the short side 17*d*. This results in a displacement of the combustion zone perpendicularly to the outlet direction 15. The flow-guidance element 17 surrounding the outlet 13 also results in such a displacement of the combustion zone in the outlet direction 15. In addition, the shape of the combustion zone is influenced by the flow-guidance element 17. The displacement of the combustion zone and the effect on the shape of the combustion zone result in an acoustic system of the burner 3 and the combustion chamber 11 being acoustically detuned. As a result, a combustion oscillation is avoided or at least attenuated.

As is seen in FIG. 1, each of the outlets 13 has an outlet diameter d and each of the flow-guidance elements 17 has a longest extent 1 along a respective element axis 17B. The longest extent 1 has a length between one-sixth and one-half of the outlet diameter d.

The flow-guidance element 17 ends at a separation edge 18. Vortices 20 separate from the fuel-gas flow 14 at this separation edge 18. As a result, a backflow zone for fuel gas is produced. Due to such a backflow zone, the combustion is stabilized and lower nitrogen-oxide formation occurs because the combustion is made more uniform.

Figure 2:
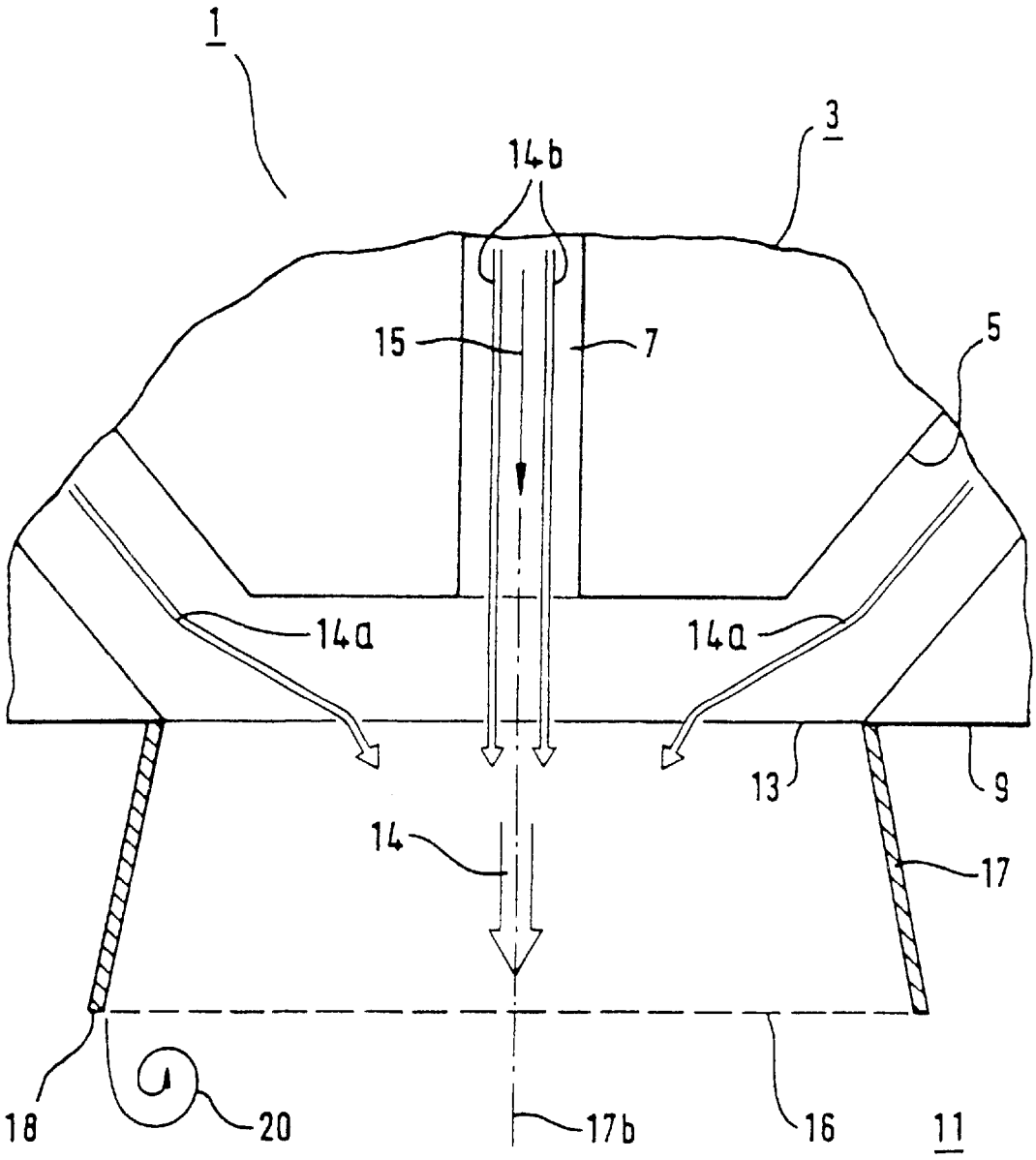
FIG. 2 is a fragmentary, diagrammatic, longitudinal-sectional view of a burner configuration with a flow-guidance element that is modified as compared with FIG. 1.

FIG. 2 shows a longitudinal section of a burner configuration 1 similar to the burner configuration 1 of FIG. 1. Unlike FIG. 1, the flow-guidance element 17 is constructed as a hollow truncated cone. The flow-guidance element 17 therefore widens in the direction of the fuel-gas flow 14. The location of the combustion of the fuel-gas flow 14 is again displaced by this flow-guidance element 17. The shape of the combustion is also influenced by the flow-guidance element 17. In this case too, a situation is achieved in which the acoustic system of the burner 3 and the combustion chamber 11 is acoustically detuned. As explained above, this results in suppression of combustion oscillations.

Figure 3:
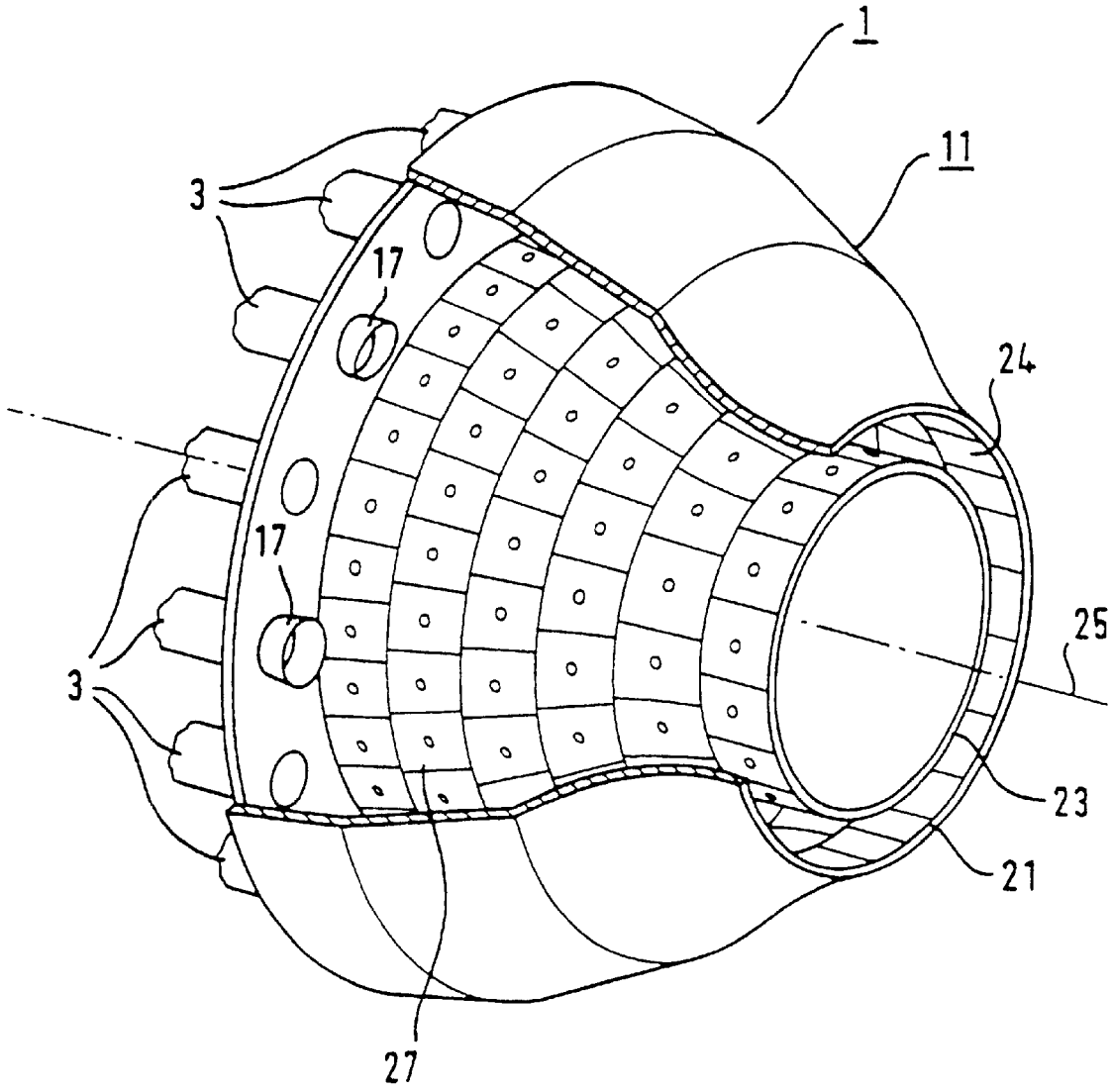
FIG. 3 is a partly broken-away perspective view of an annular combustion chamber of a gas turbine.

An annular combustion chamber for a gas turbine is shown in FIG. 3 in a perspective and partly broken-away view. A combustion chamber 11 lies rotationally symmetrically about a combustion-chamber axis 25 and has an outer wall 21 and an inner wall 23. The outer wall 21 and the inner wall 23 enclose an annular combustion space 24. An inner surface of the outer wall 21 and an outer surface of the inner wall 23 are provided with a refractory inner lining 27. A multiplicity of burners 3 are disposed in the combustion chamber 11 in a circumferential direction. Flow-guidance elements 17 are disposed at some of the burners 3. The system of the burners 3 and the combustion chamber 11 is acoustically detuned by a suitable orientation and configuration of the flow-guidance elements 17, in such a way that suppression of combustion oscillations results. This is necessary in particular in the case of the considerable geometrical complexity of an annular combustion chamber having a multiplicity of burners, since it is virtually impossible to predict the acoustic properties of such an annular combustion chamber 11.

We claim:

1. A burner configuration, comprising:

a combustion chamber;

a multiplicity of burners disposed in said combustion chamber, each of said burners having an outlet opening into said combustion chamber; and flow-guidance elements each at least partly forming a respective one of said outlets of only some of said burners, said flow-guidance elements projecting into said combustion chamber for guiding a fuel-gas flow discharging from said burners into said combustion chamber.

2. The burner configuration according to claim 1, wherein each of said flow-guidance elements is oriented along a respective element axis and is a hollow cylinder surrounding a respective one of said outlets.

3. The burner configuration according to claim 1, wherein each of said flow-guidance elements is oriented along a respective element axis and is a hollow truncated cone surrounding a respective one of said outlets.

4. The burner configuration according to claim 2, wherein said hollow cylinder ends at a top surface sloping relative to said element axis.

5. The burner configuration according to claim 3, wherein said hollow truncated cone ends at a top surface sloping relative to said element axis.

6. The burner configuration according to claim 1, wherein each of said flow-guidance elements is a wall element drawn partly around a respective one of said outlets.

7. The burner configuration according to claim 1, wherein each of said flow-guidance elements is a wall element drawn around approximately half of a respective one of said outlets.

8. The burner configuration according to claim 1, wherein said combustion chamber is an annular combustion chamber of a gas turbine.

9. The burner configuration according to claim 1, wherein each of said outlets has an outlet diameter, each of said flow-guidance elements has a longest extent along a respective element axis, and said longest extent has a length between one-sixth and one-half of said outlet diameter.

* * * * *